United States Patent [19]

Miller et al.

[11] Patent Number: 4,539,535

[45] Date of Patent: Sep. 3, 1985

[54] FOUR PORT PHASE SHIFTER

[75] Inventors: Coleman J. Miller, Arnold; Robert R. Barron, Greenbelt, both of Md.

[73] Assignee: Westinghouse Electric Corp., Pittsburgh, Pa.

[21] Appl. No.: 522,899

[22] Filed: Aug. 12, 1983

[51] Int. Cl.[3] ..... H01P 1/185

[52] U.S. Cl. ..... 333/164; 333/161; 333/246

[58] Field of Search ..... 333/156–157, 333/160, 161, 164, 139, 103, 104, 136, 262, 246; 332/29 R, 29 M, 30 R, 30 V

[56] References Cited

U.S. PATENT DOCUMENTS

| | | | |
|---|---|---|---|
| 3,571,765 | 3/1971 | Friedman | 333/164 |
| 3,789,329 | 1/1974 | Johnson | 333/139 |
| 4,105,959 | 8/1978 | Stachejko | 333/161 |
| 4,205,282 | 5/1980 | Gipprich | 333/161 |
| 4,232,399 | 11/1980 | Heiter | 455/276 |
| 4,366,454 | 12/1982 | Salzberg | 333/164 |

OTHER PUBLICATIONS

Garver, Robert V., Broad Band Diode Phase Shifters, IEEE Transactions on Microwave Theory and Techniques, vol. MIT-20, No. 5, May 1972, pp. 314–323.

Atwater, Harry A., Reflection Coefficient Transformations for Phase Shift Circuits, IEEE Transactions on Microwave Theory and Techniques, vol. MIT-28, No. 6, Jun. 1980, pp. 563–568.

*Primary Examiner*—Marvin L. Nussbaum

*Attorney, Agent, or Firm*—J. B. Hinson

[57] ABSTRACT

A circuit for phase shifting a signal has been described incorporating a four port network containing a plurality of impedances wherein each impedance is provided by a transmission line having a predetermined characteristic impedance and predetermined phase length and wherein an input signal is coupled to the first port, an output signal is coupled to the second port, a first diode is coupled to the third port, a second diode is coupled to a fourth port and means for biasing the diodes to be conducting at first times and nonconducting at second times. The phase shifter circuit overcomes the problem of phase error, amplitude modulation and voltage standing wave ratio over a predetermined frequency range.

12 Claims, 8 Drawing Figures

FOUR PORT PHASE SHIFTER

BACKGROUND OF THE INVENTION

1. Field of the Invention

This invention relates to phase shifters and more particularly to microwave phase shifters.

2. Description of the Prior Art

Conventional phase shift circuitry for phase shifts greater than $22\frac{1}{2}°$ uses reflection-type circuitry since large phase shifts are difficult to achieve with loaded line circuits. Conventional phase shift circuitry may use a perfect or assumed perfect 3 decibel hybrid coupler, with intervening circuitry between the coupler and the diodes to provide the desired phase shift. By using a 3 decibel hybrid coupler and circuitry between the coupler and the diodes, constraints are placed on the diodes and the intervening circuitry to such an extent that the desired characteristics of the phase shift circuitry such as phase flatness, voltage standing wave ratio (VSWR), insertion loss, and amplitude modulation cannot be realized in a repeatable manner among a number of manufactured phase shifter circuits.

In U.S. Pat. No. 4,205,282 which issued on May 27, 1980 to J. W. Gipprich and assigned to the assignee herein, a phase shifting circuit element was described using reflection-type circuitry. FIG. 1 shows a 3 dB coupler having four ports with 2 ports coupled through respective reactive networks 22 and 24 to respective diodes 18 and 20. In FIG. 6 a conventional branch line quadrature coupler 76 is shown having parallel line pairs 82 and 84 coupled between port 2 at 90 and PIN diode 94. Line pairs 86 and 88 are coupled between port 3 at 92 of hybrid coupler 76 and PIN diode 98. Parallel line pairs 82–84 and 86–88 are adjusted in length such as a quarter wavelength or less to provide a predetermined phase shift.

In U.S. Pat. No. 4,105,959 which issued on Aug. 8, 1978 to V. Stachejko, a hybrid coupled phase shifter is described for introducing a predetermined phase shift in a microwave frequency signal. A pair of transmission lines 18 and 20 are interconnected at their centerpoints by a branch transmission line 22 having approximately the same width as lines 18 and 20, and interconnected at their respective extremities by narrow branch transmission lines 24 and 26. Branch transmission lines 22, 24 and 26 are approximately one-quarter wavelength long at the center frequency of operation, and transmission lines 18 and 20 are approximately one-half wavelength long. Diodes 32 and 34 are coupled at the end of transmission lines 18 and 20 respectively to provide an open or a shorted termination to transmission lines 18 and 20. Highly resistive material 56 through 59 is disposed on transmission lines 18 and 20 as shown in FIG. 1 to provide energy absorbers for balancing the insertion loss through the circuit between times when the diode is conducting and non-conducting.

In U.S. Pat. No. 3,789,329 which issued on Jan. 29, 1974 to G. E. Johnson, an 8-bit digital phase shifter is shown in FIG. 1. Phase shifting networks 40, 42 and 44 use a 3 dB hybrid and PIN diodes which are forward bias at times to provide a predetermined phase shift.

It is therefore desirable to provide a phase shifter element utilizing a 4-port coupler which has transmission lines of various impedances and lengths.

It is further desirable to provide a phase shifter element utilizing a 4-port circuit which incorporates transmission lines of various impedances and lengths at the mid-band frequency which results in fewer constraints on the diodes.

It is further desirable to provide a phase shifter circuit element using a 4-port circuit which selected transmission line impedances and phase lengths for a predetermined phase shift which has phase flatness over a band of desired frequencies, a low voltage standing wave ratio, a uniform insertion loss across the band, and low amplitude modulation.

It is further desirable to provide a phase shifter using a hybrid circuit having transmission line lengths and impedances selected to provide 3.5 decibel maximum insertion loss, ±0.5 decibel maximum amplitude modulation, and a 1.5:1 maximum input and output VSWR.

SUMMARY OF THE INVENTION

In accordance with the present invention, a circuit for phase shifting a signal within a predetermined frequency range by a predetermined amount is provided comprising a first port adapted for coupling to an input signal and coupled through a first impedance to a second port, the second port adapted for providing an output signal, the first port coupled through a second, third and fourth impedance respectively in series to a third port, the second port coupled through a fifth, sixth and seventh impedance respectively in series to a fourth port, an eighth impedance coupled between the junction of the second and third impedances and the junction of the fifth and sixth impedances, a ninth impedance coupled between the junction of the third and fourth impedances and the junction of the sixth and seventh impedances, the first, second, third, fourth, eighth and ninth impedances each having an impedance substantially different from one another, a first diode coupled to the third port, a second diode coupled to the fourth port, and means for biasing the first and second diodes to provide a tenth and eleventh diode impedance respectively at first times and to provide a twelfth and thirteenth diode impedance respectively at second times.

The invention further provides a circuit for phase shifting a signal within a predetermined frequency range by a predetermined amount comprising a first port adapted for coupling to an input signal and coupled through a first, second and third impedance to a second port, the second port adapted for providing an output signal, a fourth impedance coupled between the junction of the first and second impedances and a third port, a fifth impedance coupled between the junction of the second and third impedance and a fourth port, the first, second and fourth impedances each having an impedance substantially different from one another, a first diode coupled to the third port, a second diode coupled to the fourth port, and means for biasing the first and second diodes to provide a sixth and seventh diode impedance respectively at first times and to provide an eighth and ninth diode impedance respectively at second times.

The invention further provides a circuit for phase shifting a signal within a predetermined frequency range by a predetermined amount comprising a first port adapted for coupling to an input signal and coupled through a first impedance to a second port, the second port adapted for providing an output signal, the first port coupled through a second and third impedance respectively in series to a third port, the second port coupled through a fourth and fifth impedance respectively in series to a fourth port, a sixth impedance coupled between the junction of the second and third impedance and the junction of the fourth and fifth impedances, the first, second, third and sixth impedances each having an impedance substantially different from one another, a first diode coupled to the third port, a second diode coupled to the fourth port, and means for biasing the first and second diodes to provide a seventh and eighth diode impedance respectively at first times and to provide a ninth and tenth diode impedance respectively at second times.

DESCRIPTION OF THE PREFERRED EMBODIMENT

Figure 1:
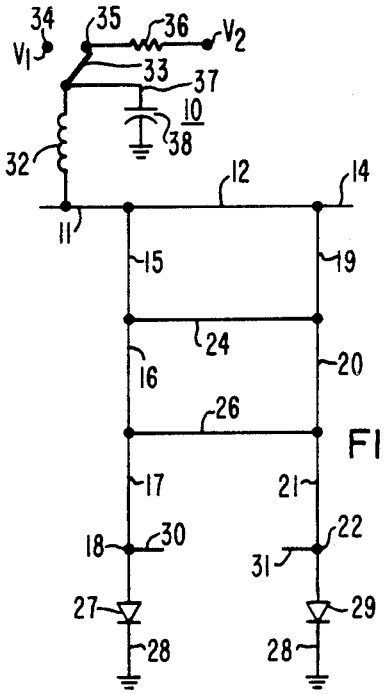
FIG. 1 is a schematic circuit of one embodiment of the invention.

Referring now to the drawing and in particular to FIG. 1, a phase shifter circuit 10 for providing a predetermined phase shift to an input signal is shown. Phase shifter circuit 10 has a first port 11 which is adapted for coupling an input circuit and is also coupled through a first impedance 12 to a second port 14. Second port 14 of phase shifter 10 is adapted for providing an output signal. The input impedance of input port 11 as well as output port 14 may be for example 25 ohms. Impedance 12 may be for example a transmission line having a characteristic impedance and having a predetermined phase length at the midband frequency of a predetermined frequency range. Input port 11 is coupled through impedances 15, 16 and 17 to a third port 18. Output port 14 is coupled through impedances 19, 20 and 21 to a fourth port 22. Impedance 24 is coupled between the junction of impedances 15 and 16 and the junction of impedances 19 and 20. Impedance 26 is coupled between the junction of impedances 16 and 17 and the junction of impedances 20 and 21. Impedances 12, 24 and 26 may be likened to branch transmission lines in a network. Impedances 15, 16, 17, 19, 20 and 21 may also be transmission lines of varying impedances. Diode 27 is coupled between third port 18 and ground potential 28. Diode 29 is coupled between fourth port 22 and ground potential 28. Diodes 27 and 29 may be for example PIN diodes such as Model No. 8-7201-81 supplied by Alpha Industries, 20 Sylvan Road, Woburn, Mass. 01801. Diodes 27 and 29 may for example have a capacitance of 0.1 picofarads with a reverse biased voltage of 50 volts and an on resistance of one-half ohm when forward biased with 100 milliamps. As shown in FIG. 1 the anode of diodes 27 and 29 are coupled to ports 18 and 22 respectively. Impedance 30 is coupled to third port 18 and functions to provide a tuning stub to cancel out the reactance of diode 27. Impedance 31 is coupled to fourth port 22 and functions to cancel out the reactance of diode 29. Impedances 30 and 31 may be for example predetermined lengths of transmission lines of a predetermined characteristic impedance. Impedances 30 and 31 may be for example a capacitive tuning stub having an impedance of 60 ohms and a length of 20° initially.

Phase shifter circuit 10 is suitable for operating over a broadband such as from 1215 megahertz to 1365 megahertz. The values of impedances 12, 15, 16, 17, 19, 20, 21, 24, 26 are shown in Table I for 45°, 90° and 180° phase shift in the form of transmission lines having a predetermined characteristic impedance and a phase length at the midband frequency of a predetermined frequency range such as, for example, A midband frequency of 1290 megahertz and a band ranging from 1215 megahertz to 1365 megahertz.

TABLE I

| | 45° Phase Shift Transmission Line | | 90° Phase Shift Transmission Line | | 180° Phase Shift Transmission Line | |
|---|---|---|---|---|---|---|
| Impedance | Impedance Ω | Length° | Impedance Ω | Length° | Impedance Ω | Length° |
| 12 | 80 | 108 | 80 | 104.8 | 80 | 97.9 |
| 15, 19 | 21.2 | 78.5 | 22.7 | 72.4 | 20 | 80.8 |
| 24 | 33.8 | 122.8 | 37.2 | 98.4 | 24 | 93.7 |
| 16, 20 | 18.6 | 63.6 | 23.8 | 74.9 | 26 | 83 |
| 26 | 43.8 | 57 | 53.8 | 76.7 | 80 | 79 |
| 17, 21 | 80 | 39 | 80 | 45 | 50 | 50 |

As shown in Table I, phase shifter 10 has particular impedance values to provide a predetermined phase shift of 45°, 90° or 180°. It is noted in Table I that impedances 12 and 24 have a phase length greater than a quarter wavelength or 90° and impedances 15, 16, 17, 19, 20, 21 and 26 have a phase length of less than 90°.

Also, impedances 12, 15, 16, 17, 24 and 26 have values substantially different from one another. Impedances 15 and 19 are substantially equal to one another. Impedances 16 and 20 are substantially equal to one another, and impedances 17 and 21 are substantially equal to one another for a particular phase shift.

Diodes 27 and 29 may be forward and reverse biased by coupling an appropriate voltage or current at port 11. For example, impedance 32 may be coupled over line 37 to a capacitor 38 and to a single pole, double throw switch 33 which may be switched between terminal 34 and terminal 35. Terminal 34 may have a voltage $V_1$ coupled to it which may for example be −15 volts to provide a reverse bias potential across diodes 27 and 29. Terminal 35 may be coupled through a resistor 36 to voltage $V_2$ which may have a positive voltage for causing diodes 27 and 29 to be forward biased by a predetermined current. Impedance 32 functions to provide high frequency isolation between the phase shifter circuit RF and the direct current bias voltages for diodes 27 and 29. Impedance 32 may be a quarter wavelength transmission line at the midband frequency acting as a choke. The current drawn through diodes 27 and 29 may be for example 100 milliamps for each diode. By coupling switch 33 to terminal 34 or 35 a phase shift may be provided at the output port 14 which, depending on the value of the impedances in phase shifter 10, can provide a predetermined phase shift, such as 45°, 90° or 180° over a broadband.

Figure 2:
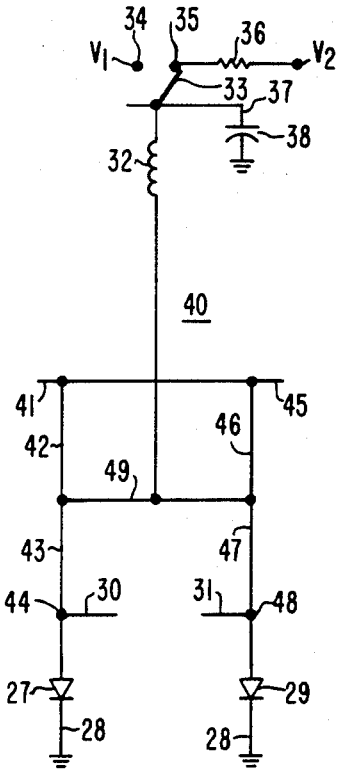
FIG. 2 is a schematic circuit of an alternate embodiment of the invention.

FIG. 2 shows an alternate embodiment, phase shifter circuit 40. In FIG. 2, like references are used for functions corresponding to the apparatus of FIG. 1. An input port 41 is adapted for coupling to an input signal and is coupled through impedance 42 and impedance 43 to a third port 44. A second port 45 is adapted for providing an output signal and is coupled through impedance 46 and 47 to a fourth port 48. Impedance 49 is coupled between the junction of impedances 42 and 44 and the junction of impedances 46 and 47. Impedances 42, 43 and 49 each have an impedance substantially different from one another. As can be seen in FIG. 2 third port 44 is coupled to the anode of diode 27. Fourth port 48 is coupled to the anode of diode 29.

Phase shifter circuit 40 is a loaded line circuit and is suitable for shifting the input signal by 22½° in phase. The specific values for impedances 42, 43, 46, 47 and 49 are shown in Table II. The impedances are represented as transmission lines having a characteristic impedance and a predetermined length at the midband frequency of a predetermined requency range. The input port 41 may be coupled to a 50 ohm transmission line and the output port 45 may be coupled to a 50 ohm transmission line. As can be seen in Table II, impedances 42 and 46 are substantially equal and impedances 43 and 47 are substantially equal.

TABLE II

| | 22½° Phase Shift Transmission Line | |
|---|---|---|
| Impedance | Impedance Ω | Length° |
| 42, 46 | 26 | 89.9 |
| 49 | 13.5 | 90.3 |
| 43, 47 | 80 | 37.5 |
| 62 | 22 | 90 |
| 63 | 30 | 90 |

Figure 3:
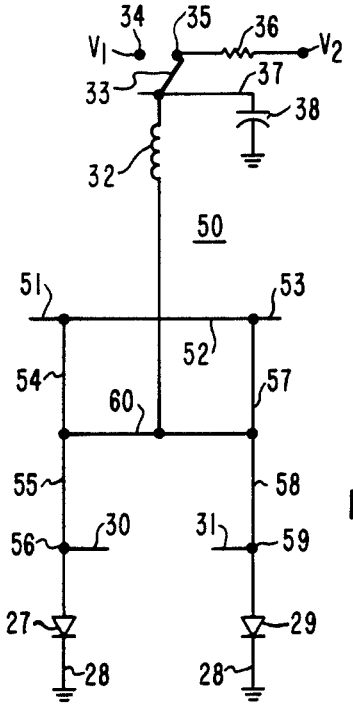
FIG. 3 is a schematic circuit of another alternate embodiment of the invention.

FIG. 3 shows a phase shifter circuit 50. In FIG. 3, like references are used for functions corresponding to the apparatus of FIG. 1. A first port 51 which also functions as an input port for an input signal is coupled through impedance 52 to a second port 53 which is adapted for providing an output signal. Input port 51 is coupled through impedance 54 and 55 to a third port 56. Second port or output port 53 is coupled through impedance 57 and 58 to a fourth port 59. Impedance 60 is coupled between the junction of impedances 54 and 55 and the junction of impedances 57 and 58.

Phase shifter circuit 50 is a loaded line circuit suitable for shifting the input signal by 5⅝° and 11¼° depending on impedance values. Impedance values for phase shifter circuit 50 to provide a 5⅝° phase shift and 11¼° phase shift is provided in Table III.

TABLE III

| | 5⅝° Phase Shift Transmission Line | | 11¼° Phase Shift Transmission Line | |
|---|---|---|---|---|
| Impedance | Impedance Ω | Length° | Impedance Ω | Length° |
| 12 | 61.3 | 270 | 68.6 | 270 |
| 54, 57 | 71.4 | 89.3 | 71.4 | 89.3 |
| 60 | 18.3 | 90.8 | 25 | 90.7 |
| 55, 58 | 80 | 36.6 | 80 | 37 |

The impedances in Table III are each represented by a transmission line having a characteristic impedance and a predetermined length determined at the midband frequency of the phase shifter. It is noted that impedances 54 and 57 are substantially equal. Also, impedances 55 and 58 are substantially equal. Further, it is noted that impedances 52, 54, 55 and 60 have a value of impedance which is substantially different from one another.

Figure 4:
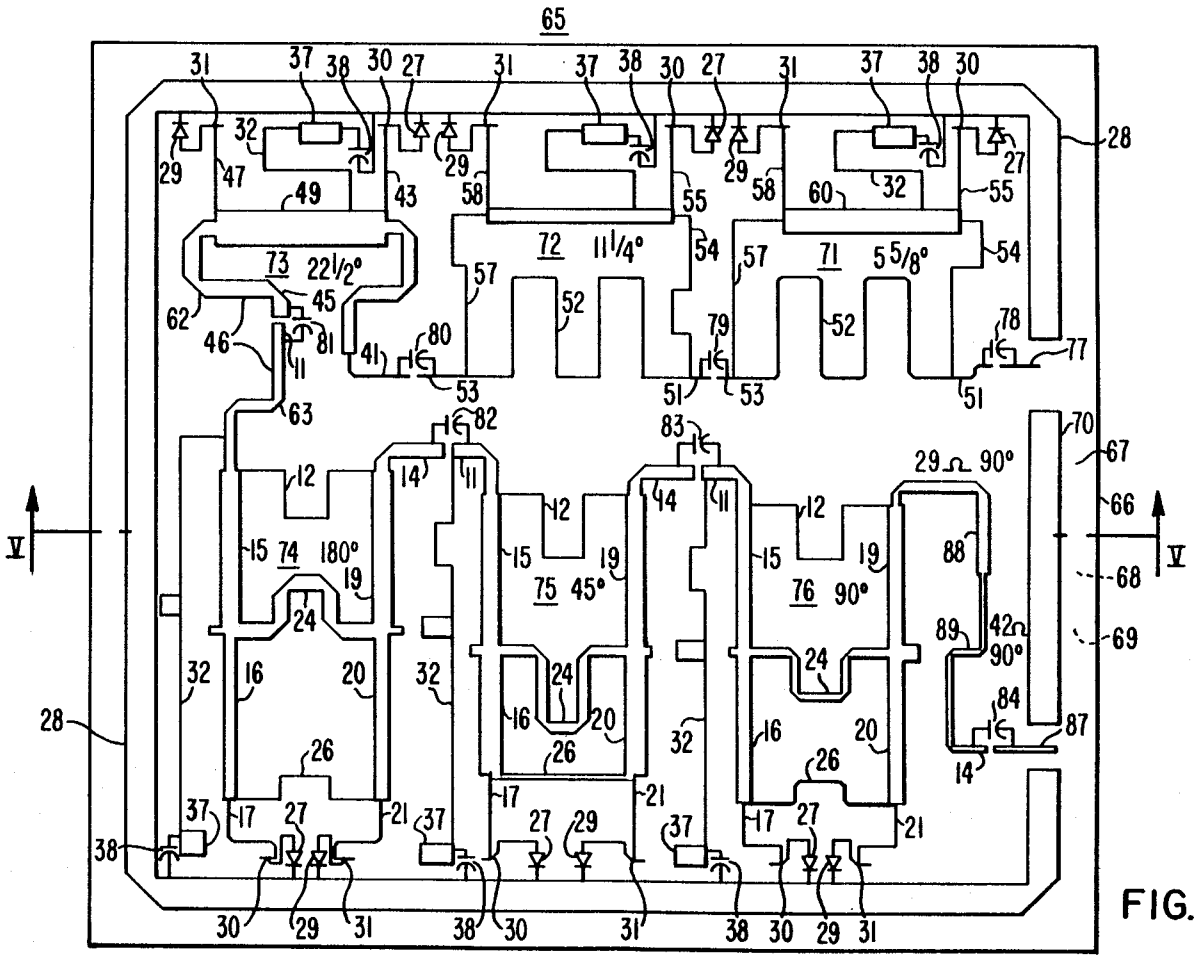
FIG. 4 is a top view of a 6-bit phase shifter incorporating the embodiments of FIGS. 1-3.
Figure 5:
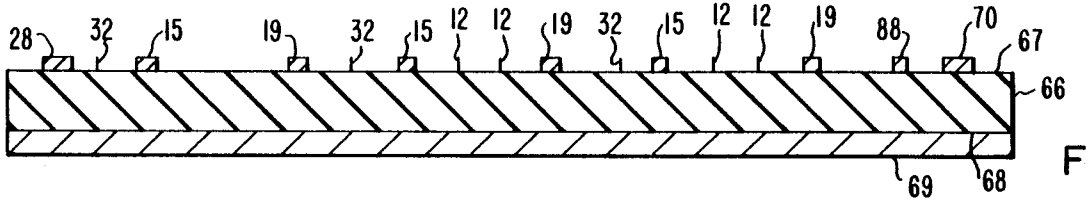
FIG. 5 is a cross-section view along the lines V—V of FIG. 4.

FIG. 4 is a top view of a 6-bit phase shifter 65. FIG. 5 is a cross-section view along the lines V—V of FIG. 4. Six-bit phase shifter 65 is fabricated on a substrate 66 having an upper surface 67 and a lower surface 68. Substrate 66 may be, for example, Teflon loaded with a ceramic and may have a relative permittivity $e_r$ of 10.5. The thickness of substrate 66 may be, for example, 0.25 inches. One source of substrate 66 may be, for example Rt/DUROID 6010, supplied by the Rogers Corporation Micromat Division, Box 700 Chandler, Ariz. 85224. The lower surface 68 may have a thick aluminum layer 60 which may provide mechanical support and rigidity and the upper surface 67 may have a layer of copper 70 thereon. As shown in FIG. 4, layer 70 has been etched to form conductive metal patterns, transmission lines, for phase shifter circuits 71 through 76.

In FIG. 4 like references are used for functions corresponding to the apparatus of FIGS. 1, 2 and 3. As shown in FIG. 4, phase shifter circuit 71 includes impedances 52, 54, 55, 57, 58 and 60 which are fabricated with transmission lines having a predetermined width to provide a characteristic impedance and a predetermined length at the mid band frequency. A microwave signal is coupled to the input 51 of phase shifter circuit 71 over line 77 and through capacitor 78. Capacitor 78 functions to isolate the bias current to diodes 27 and 29 from the input. Other capacitors 79 through 84 are coupled at the output of phase shifter circuit 71 through 76 respectively and function to isolate the bias current within the respective phase shifter circuit. Capacitors 78 through 84 may each have, for example, a value of 120 picofarads. Conductor 28 at the perimeter of substrate 66 on upper surface 67 functions provide a ground connection for the diodes of phase shifter circuits 71 through 76. The input impedance of phase shifter circuit 71 is 50 ohms and the output impedance at output port 53 is 50 ohms.

Phase shifter circuit 72 is similar to phase shifter 71 except the line widths and line lengths may be varied to provide a predetermined characteristic impedance for each impedance and a predetermined phase length at the mid band frequency of a phase shifter. Phase shifters 71 and 72 correspond to the embodiment of FIG. 3 and may use impedance values from Table III. Phase shifter 71 provides 5⅝° phase shift while phase shifter 72 provides 11¼° phase shift in response to a bias current applied to its respective terminal 37. The input and output impedance of phase shifter 72 is 50 ohms.

Phase shifter 73 has an input impedance of 50 ohms. Phase shifter 73 corresponds to the schematic circuit of FIG. 2 and provides a phase shift of 22½°. The values of the impedances of phase shifter circuit 73 are each given in Table II, represented as a transmission line having a characteristic impedance and transmission line phase length at the mid band frequency of the phase shifter 73.

In FIG. 4 impedance 46 is modified to provide an output impedance of 25Ω from phase shifter 73 to interface with phase shifter 74. Impedance 46 may comprise impedances 62 and 63 having values shown in Table II.

The output of phase shifter 73 is coupled to the input of phase shifter 74 through capacitor 81. Phase shifter 74 functions to provide a phase shift of 180°. Phase shifter 74 corresponds to the schematic diagram of FIG. 1. The impedance values for phase shifter 74 is found in Table I.

The output of phase shifter 74 is coupled to the input of phase shifter 75. Phase shifter 75 corresponds to the schematic layout of FIG. 1 and has values selected to provide a phase shift of 45°. The values are found in Table I.

The output of phase shifter 75 is coupled to the input of phase shifter 76. Phase shifter 76 corresponds to the schematic diagram of FIG. 1 and has values provided in Table I to provide a phase shift of 90°. The output of phase shifter 76 is coupled through capacitor 84 to output terminal 87.

The input and output impedance of phase shifters 74 through 76 was selected to be 25 ohms so that impedance 12 and 26 would be wide enough to print or fabricate on substrate 66. Impedance 12 is implemented with a transmission line having a characteristic impedance of 80 ohms.

Each phase bit of six bit phase shifter 65 had values chosen to optimize phase shift, voltage standing wave ratio (VSWR), and insertion loss. The phase shifter circuit of each phase bit was expressed by a number of linear equations. The equations were solved in an iterative process and values were substituted for the impedances which moved in the direction of optimized phase shift, voltage standing wave ratio and insertion loss. A computer program such as "SUPER COMPACT version 1.6" provided by Comsat General Integrated System, Inc. located at 1131 San Antonio Road, Palo Alto, Calif. 94303 may be used in solving the linear equations. By optimizing the phase shifter circuit, the values selected for the impedances provided a circuit which departed from the previous circuit approaches of using or assuming the use of a perfect 3 dB hybrid coupler.

Figure 6:
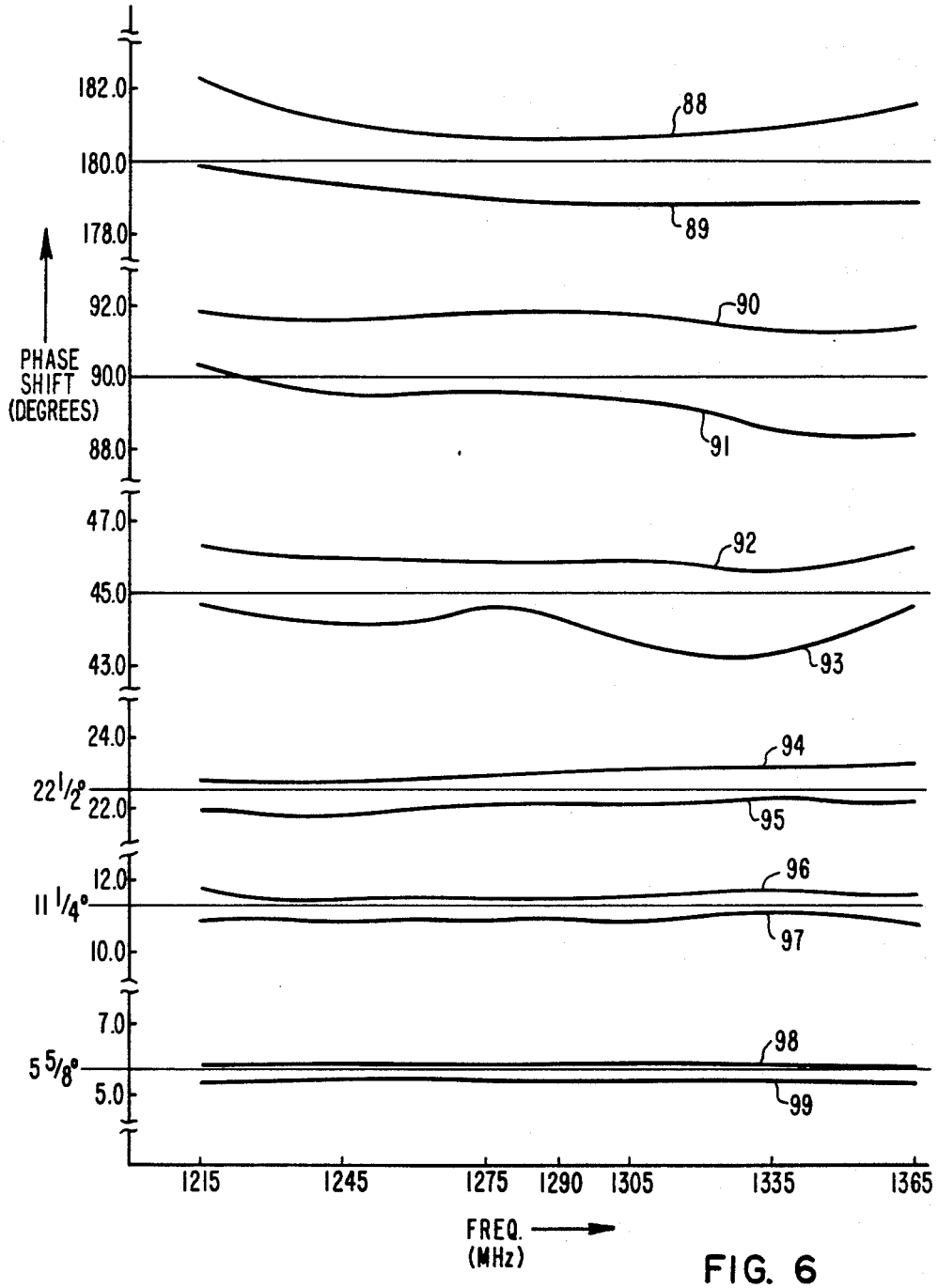
FIG. 6 shows the variation in phase shift of twelve 6-bit phase shifters over frequency for each of the 6bits.

FIG. 6 shows the range of phase shift data for each of six bits of the embodiment of FIG. 4 over frequency. In FIG. 6 the ordinate represents phase shift and the abscissa represents a frequency. The data in FIG. 6 is supplied from 12 prototype units of the six bit phase shifter circuit 65 shown in FIG. 4. In FIG. 6, curve 88 represents the maximum phase shift and curve 89 represents the minimum phase shift when phase shifter circuit 74 is switched by causing diodes 27 and 29 to be conductive or nonconductive by applying bias current to line 37. Curve 90 represents the maximum phase shift and curve 91 represents the minimum phase shift for phase shifter circuit 76 when bias current is applied or removed. Curve 92 represents the maximum phase shift and curve 93 represents the minimum phase shift at times when phase shifter circuit 75 has bias current applied or removed.

Phase shifter circuit 74 was designed to provide a 180° phase shift. Phase shifter circuit 75 was designed to provide a 45° phase shift. Phase shifter circuit 76 was designed to provide a 90° phase shift.

Curve 94 represents the maximum phase shift and curve 95 represents the minimum phase shift for phase shifter circuit 73 when bias current is applied or removed. Curve 96 represents the maximum phase shift and curve 97 represents the minimum phase shift for phase shifter circuit 72 when bias current is applied or removed. Curve 98 represents the maximum phase shift and curve 99 represents the minimum phase shift for phase shifter circuit 71 when bias current is applied or removed.

Phase shifter circuit 73 was designed to provide a $22\frac{1}{2}$° phase shift. Phase shifter circuit 72 was designed to provide a 11.25° phase shift. Phase shifter circuit 71 was designed to provide a 5.6° phase shift.

Figure 7:
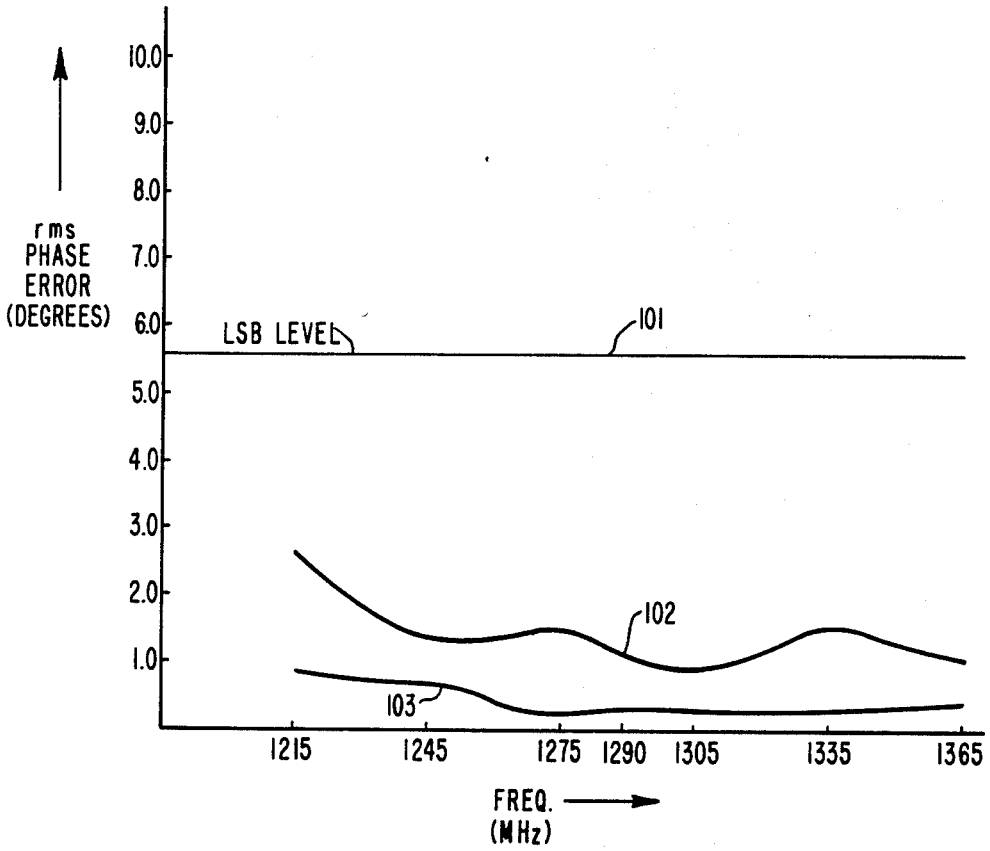
FIG. 7 shows the root mean square (rms) of the phase error for all 64 states of twelve 6-bit phase shifters over frequency.

FIG. 7 shows the root mean square (rms) phase error for all 64 states of 12 six bit phase shifters 65 of FIG. 4 over frequency. In FIG. 7 the ordinate represents phase error in degrees and the abscissa represents frequency in megahertz. Curve 101 shows the phase shift of the least significant bit, namely 5.6 degrees. Curve 102 shows the maximum root mean square phase error over frequency and curve 103 shows the minimum root mean square phase error over frequency. Curves 102 and 103 were determined after plotting the root mean square error of each unit of 12 six bit phase shifters. It is understood that the root mean square error was determined by taking the square root of the sum of the squares of the deviation about the desired phase shift divided by the number of samples where n is 64 for the 64 states of the six bit phase shifter. As shown in FIG. 7, the maximum root mean square phase error across the band from 1215 to 1365 megahertz is 2.8 degrees or less.

Figure 8:
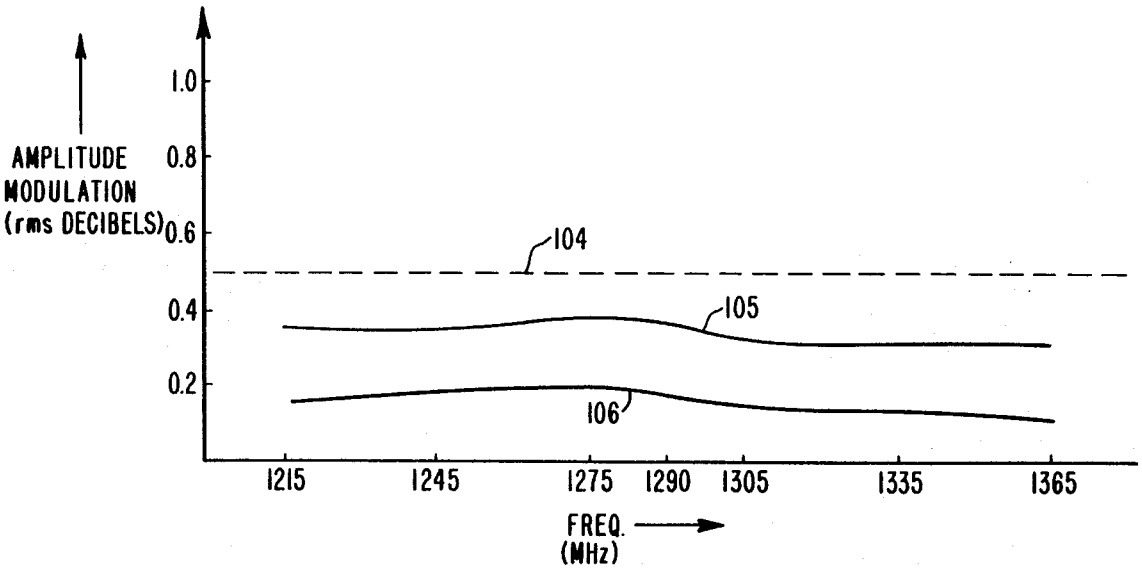
FIG. 8 shows the root mean square (rms) of the amplitude modulation for all 64 states of twelve 6-bit phase shifters over frequency.

FIG. 8 shows the root mean square (rms) of the amplitude modulation for all 64 states of 12 six bit phase shifters 65 of FIG. 4 over frequency. In FIG. 8 the ordinate represents amplitude modulation in decibels and the abscissa represents frequency in megahertz. The amplitude modulation is the change in amplitude of the output signal over the possible 64 states. Alternately the amplitude modulation or variation in amplitude may be considered due to the variation of insertion loss of the phase shifter circuit. Curve 104 represents the system requirement of 0.5 dB. Curve 105 represents the maximum amplitude modulation over frequency and curve 106 represents the minimum amplitude modulation over frequency. Curves 105 and 106 were determined by taking the maximum and minimum value after plotting the amplitude modulation root mean square for each of 12 units over 64 states over frequency from 1215 megahertz to 1365 megahertz. In FIGS. 6 through 8 the mid band frequency is 1290 megahertz and the frequency range or band is from 1215 to 1365 MHz.

As shown in FIG. 8 the root mean square amplitude modulation is less than 0.5 decibels.

With the embodiment of FIG. 4 the additional goals of 3.5 dB maximum insertion loss and a 1.5 to 1 maximum input and output voltage standing wave ratio were achieved.

A six bit phase shifter circuit has been designed and fabricated using a four port circuit wherein the impedances are varied from an original 3 dB coupler. Phase shifter circuits for 180, 90, 45, $22\frac{1}{2}$, 11–14, and $5\frac{5}{8}$ degrees have been shown operable over a frequency range from 1215 megahertz to 1365 megahertz. The impedances of the four port network were implemented using a transmission line having a predetermined characteristic impedance and a predetermined wavelength at the mid band frequency.

We claim:

1. A circuit for phase shifting a signal within a predetermined frequency range by a predetermined amount comprising:

a first port adapted for coupling to an input signal and coupled through a first impedance to a second port, said second port adapted for providing an output signal, said first port coupled through a second, third and fourth impedance respectively in series to a third port, said second port coupled through a fifth, sixth and seventh impedance respectively in series to a fourth port, an eighth impedance coupled between the junction of said second and third impedances and the junction of said fifth and sixth impedances, a ninth impedance coupled between the junction of said third and fourth impedances and the junction of said sixth and seventh impedances, said first, second, third, fourth, eighth and ninth impedances each having an impedance substantial different from one another, a first diode coupled to said third port, a second diode coupled to said fourth port, and means for biasing said first and second diodes to provide a tenth and eleventh diode impedance respectively at first times and to provide a twelfth and thirteenth diode impedance respectively at second times.

2. The circuit of claim 1 wherein at least one of said first through ninth impedances includes a microstrip transmission line having a predetermined characteristic impedance and length at the middle of said frequency range.

3. The circuit of claim 1 wherein said second impedance is substantially equal to said fifth impedance and wherein each includes a microstrip transmission line having a predetermined characteristic impedance and length at the middle of said frequency range.

4. The circuit of claim 1 wherein said third impedance is substantially equal to said sixth impedance and wherein each includes a microstrip transmission line having a predetermined characteristic impedance and length at the middle of said frequency range.

5. The circuit of claim 1 wherein said fourth impedance is substantially equal to said seventh impedance and wherein each includes a microstrip transmission line having a predetermined characteristic impedance and length at the middle of said frequency range.

6. A circuit for phase shifting a signal within a predetermined frequency range by a predetermined amount comprising:

a first port adapted for coupling to an input signal and coupled through a first, second and third impedance to a second port, said second port adapted for providing an output signal, a fourth impedance coupled between the junction of said first and second impedance and a third port, a fifth impedance coupled between the junction of said second and third impedances and a fourth port, said first, second and fourth impedances each have an impedance substantially different from one another, a first diode coupled to said third port, a second diode coupled to said fourth port, and means for biasing said first and second diodes to provide a sixth and seventh diode impedance respectively at first times and to provide an eighth and ninth diode impedance respectively at second times.

7. The circuit of claim 6 wherein said first impedance is substantially equal to said third impedance and wherein each includes a microstrip transmission line having a predetermined characteristic impedance and length at the middle of said frequency range.

8. The circuit of claim 6 wherein said fourth impedance is substantially equal to said fifth impedance, each including a microstrip transmission line having a predetermined characteristic impedance and length at the middle of said frequency range.

9. A circuit for phase shifting a signal within a predetermined frequency range by a predetermined amount comprising:

a first port adapted for coupling to an input signal and coupled through a first impedance to a second port, said second port adapted for providing an output signal, said first port coupled through a second and third impedance respectively in series to a third port, said second port coupled through a fourth and fifth impedance respectively in series to a fourth port, a sixth impedance coupled between the junction of said second and third impedances and the junction of said fourth and fifth impedances, said first, second, third and sixth impedances each having an impedance substantially different from one another, a first diode coupled to said third port, a second diode coupled to said fourth port, and means for biasing said first and second diodes to provide a seventh and eighth diode impedance respectively at first times and to provide a ninth and tenth diode impedance respectively at second times.

10. The circuit of claim 9 wherein said second impedance is substantially equal to said fourth impedance, each including a microstrip transmission line having a predetermined characteristic impedance and length at the middle of said frequency range.

11. The circuit of claim 9 wherein said third impedance is substantially equal to said fifth impedance, each including a microstrip transmission line having a predetermined characteristic impedance and length at the middle of said frequency range.

12. A circuit for phase shifting a signal within a predetermined frequency range by predetermined amounts in response to a plurality of control signals comprising a plurality of phase shifters coupled in series, each phase shifter providing a predetermined phase shift comprising a first port adapted for coupling to an input signal and coupled through a first impedance to a second port, said second port adapted for providing an output signal, said first port coupled through a second, third and fourth impedance respectively in series to a third port, said second port coupled through a fifth, sixth and seventh impedance respectively in series to a fourth port, an eighth impedance coupled between the junction of said second and third impedances and the junction of said fifth and sixth impedances, a ninth impedance coupled between the junction of said third and fourth impedances and the junction of said six and seventh impedances, said first, second, third, fourth, eighth and ninth impedances each having an impedance substantially different from one another, a first diode coupled to said third port, a second diode coupled to said fourth port, and means for biasing said first and second diodes to provide a tenth and eleventh diode impedance respectively at first times and to provide a twelfth and thirteenth diode impedance respectively at second times, said means for biasing coupled to a respective one of said plurality of control signals.

* * * * *